United States Patent [19]

Wu

[11] Patent Number: 4,863,375

[45] Date of Patent: Sep. 5, 1989

[54] BAKING METHOD FOR USE WITH LIQUID OR POWDER VARNISHING FURNACE

[76] Inventor: Ching-Shun Wu, No. 22, Shin Chen St., Tainan, Taiwan

[21] Appl. No.: 189,417

[22] Filed: May 2, 1988

[51] Int. Cl.[4] ..... F27B 9/00; F23G 7/00

[52] U.S. Cl. ..... 432/121; 110/236; 432/59; 432/75

[58] Field of Search ..... 432/8, 59, 2, 75, 121; 110/236

[56] References Cited

U.S. PATENT DOCUMENTS 2,852,418 9/1958 MacDonald ..... 110/236
2,925,821 2/1960 MacDonald ..... 110/236
4,136,624 1/1979 Kato et al. ..... 110/236
4,141,373 2/1979 Kartanson et al. ..... 110/236
4,759,298 7/1988 Koptis et al. ..... 110/236

*Primary Examiner*—Henry C. Yuen
*Attorney, Agent, or Firm*—Lowe, Price, LeBlanc, Becker & Shur

[57] ABSTRACT

This invention relates to a method of using a liquid or powder varnishing furnace utilizing near-ultrared bulbs to form high temperature regions and low temperature regions which are alternatively disposed and spaced apart by a fixed distance to heat a cleaned and painted workpiece, whereby the workpiece is dried rapidly and paint sprayed onto the workpiece firmly adheres thereto.

3 Claims, 3 Drawing Sheets

BAKING METHOD FOR USE WITH LIQUID OR POWDER VARNISHING FURNACE

BACKGROUND OF THE INVENTION

It has been found that the conventional baking method comprises the steps of treating the surface of the workpiece to cause it not to have weak acidic property and to prevent it from oxidizing, which would otherwise make paint separate from the workpiece, an undercoating treating step for applying a first coating to the workpiece, a heating in a furnace to heat the workpiece from a low to medium temperature, a mobile immersion for applying paint on the workpiece surface, and heating in a furnace utilizing a blast fan, gas or far ultrared radiation to heat the workpiece surface to a temperature above the melting point of the paint, and then cooling of the workpiece.

It should be noted that according to conventional methods, the workpiece first enters into a low temperature region, then a medium temperature and a high temperature region so as to dry the paint film on the surface of the workpiece, and consequently has the following deficiencies:

1. It is necessary to have a lot of equipment for the furnace, thereby increasing the cost.
2. The furnace is increased in length and so it will take a long time for the formation of the product and it will be unfit for mass production.
3. The air transmitted into the furnace contains suspended particles which may dirty the workpiece surface.
4. The paint cannot firmly adhere on the workpiece.
5. The method may present poisoning, pollution and fire accident risks.
6. The energy cost is rather high.
7. The whole installation is too large in volume.

It is, therefore, an object of the present invention to provide an improved method which may overcome the above-mentioned drawbacks.

SUMMARY OF THE INVENTION

This invention relates to a baking method for use with a liquid or powder varnishing furnace.

It is the primary object of the present invention to provide a baking method which is safe in use.

It is another object of the present invention to provide a baking method which can produce good quality products.

It is still another object of the present invention to provide a baking method which is energy-saving.

It is still another object of the present invention to provide a baking method which can cause the paint to adhere firmly to a workpiece.

It is still another object of the present invention to provide a baking method which can be carried out at a relatively low cost.

It is a further object of the present invention to provide a baking method which is suitable for mass production.

It is still a further object of the present invention to provide a baking method which can reduce the length of the furnace.

DETAILED DESCRIPTION OF THE PREFERRED EMBODIMENT

Figure 1:
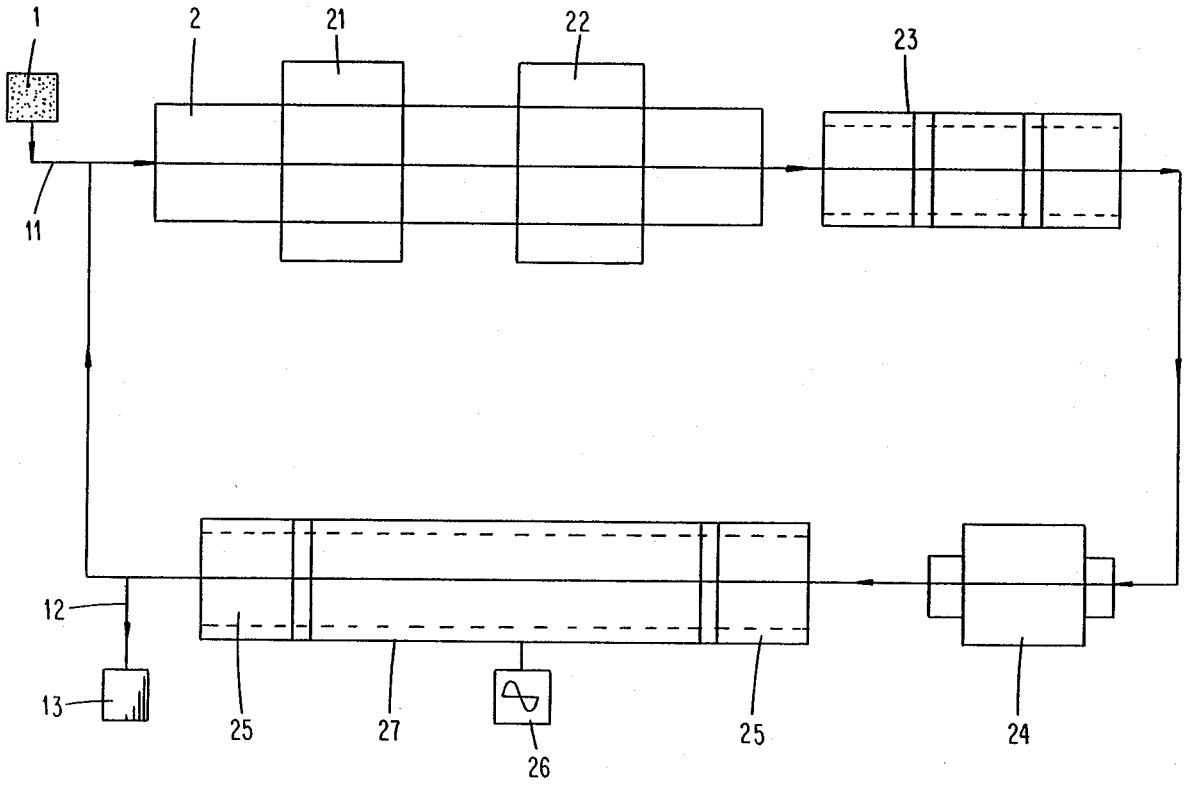
FIG. 1 is a flow chart of the present invention.

With reference now to FIG. 1, there is shown the flow chart of the present invention. As illustrated, the workpiece 1 first enters into the drying process for varnishing from inlet 11, and is then subjected to degreasing treatment 21 at pre-treating region 2 so as to clean off greasy spots therefrom. Thereafter, the workpiece 1 is thoroughly treated to a washing at 22 and dehydrated by near-ultrared radiation which removes the easily oxidized weak acidic water, and is transmitted to a spray painting platform. Afterwards, the workpiece 1 is transferred into a furnace 27 for baking which may be controlled by a voltage-regulator 26 and then passed through an insulated region 25 for cooling, thereby forming a finished product 13. The product may then be taken out from the exit 12.

Figure 2:
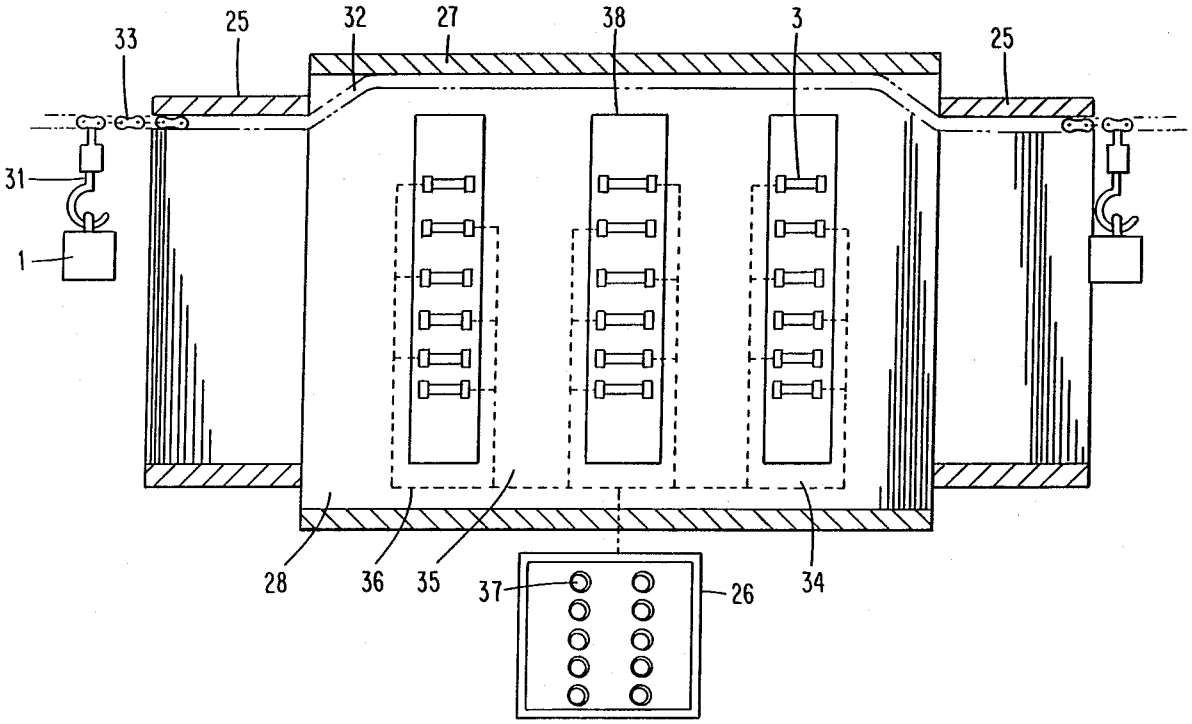
FIG. 2 is a sectional view of the furnace of the present invention.
Figure 3:
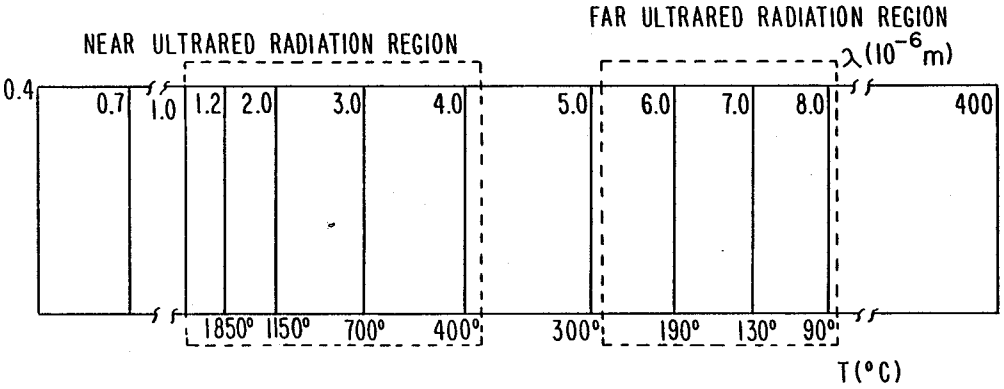
FIG. 3 is a wavelength diagram.

FIG. 2 shows the furnace for carrying out the method according to the present invention. The furnace 27 is provided with a plurality of near-ultrared radiation bulbs 3 which will give out instant high heat and intense penetration near-ultrared radiation to a 380°–390° C. liquid furnace or a 400°–600° C. powder furnace disposed 2–3 cm in front of the bulb 3. Hence, the painting on the workpiece 1 will be rapidly dried thereby increasing its adhesion thereto. The furnace 27, for example, is merely 9 meters in length for one way flow therethrough and 4 meters in length for double flow, or 10 meters in length for one way flow and 5 meters in length for double flow.

The workpiece 1 is suspended on a chain hook 31 which is connected to the interior of the furnace 27 by means of a chain 33 through a passage 32. The furnace 27 is provided with a rapid solvent volatilizing region 28 (for liquid). In case the region 28 is used for powder, additional light bulbs 3 may be disposed under the bottom hereof so to increase the temperature, raising the operational speed. The high temperature region 34 and low temperature region 35 are formed equally spaced apart from one another. The high temperature region 34 is comprised by equidistant near-ultrared bulbs 3. When the workpiece 1 to be varnished passes through a region 28 and the high temperature region 34, it will be baked by the near-ultrared radiation emitted from the bulbs 3. Then, the workpiece 1 is transferred through the low temperature region 35 and insulating region 25 and then taken out of the exit 12 as a product. However, it should be noted that the near-ultrared radiation bulb sockets 38 may conveniently contain an odd number of bulbs 3 or an even number of bulbs 3 connected to the voltage regulator 26 via a conducting wire 36. Regulator 26 is controlled by a switch 37.

As various changes may be made in the present invention without departing from the spirit and scope thereof and without sacrificing any of its advantages, it is to be understood that all matter herein is to be interpreted as illustrative and not in a limiting sense.

I claim:

1. A baking method for use with a liquid or powder varnishing furnace to paint a workpiece, comprising the steps of:

degreasing the workpiece at a pre-treating region to remove grease therefrom;

washing the workpiece thoroughly with water;

dehydrating the workpiece by exposing it to near-ultrared radiation;

moving the workpiece to a spray painting platform and spraying paint on the workpiece thereat; and transferring the workpiece into a furnace for baking, said furnace being provided with several rows of near-ultrared radiation bulbs for baking said workpiece, said bulbs being disposed to provide a low temperature region between adjacent rows of the bulbs with said baking occurring by application of said near-ultrared radiation from both sides as said workpiece is moved between said adjacent rows of bulbs;

whereby the workpiece is dried rapidly and the sprayed on paint firmly adheres thereto.

2. The method according to claim 1, wherein:

said varnishing furnace is a liquid furnace and said bulbs provide a temperature in the range 380° C.–390° C.

3. The method according to claim 1, wherein:

said varnishing furnace is a powder furnace and said bulbs provide a temperature in the range 400° C.–600° C.

* * * * *